US006784673B2

(12) United States Patent
Tomasi et al.

(10) Patent No.: US 6,784,673 B2
(45) Date of Patent: Aug. 31, 2004

(54) CONDITION SENSOR FOR A DRYER

(75) Inventors: Donald Mark Tomasi, Stevensville, MI (US); Thomas R. Olson, Chesterton, IN (US); Shawn R. Oltz, Niles, MI (US); James I. Czech, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/242,957

(22) Filed: Sep. 13, 2002

(65) Prior Publication Data

US 2004/0051540 A1 Mar. 18, 2004

(51) Int. Cl.[7] ..... G01R 27/26
(52) U.S. Cl. ..... 324/664; 34/441
(58) Field of Search ..... 324/664; 34/441, 34/315

(56) References Cited

U.S. PATENT DOCUMENTS

| | | | | | |
|---|---|---|---|---|---|
| 4,422,247 | A | | 12/1983 | Deschaaf | 34/48 |
| 4,702,016 | A | | 10/1987 | Grigsby et al. | 34/33 |
| 4,896,795 | A | * | 1/1990 | Ediger et al. | 222/63 |
| 4,909,070 | A | * | 3/1990 | Smith | 73/73 |
| 5,016,364 | A | * | 5/1991 | Cochrane | 34/202 |
| 5,144,755 | A | * | 9/1992 | Braun et al. | 34/560 |
| 5,333,393 | A | | 8/1994 | Hill et al. | 34/440 |
| 5,367,265 | A | * | 11/1994 | Gaudette | 307/650 |
| 5,737,852 | A | * | 4/1998 | Shukla et al. | 34/528 |
| 5,974,693 | A | | 11/1999 | Richards et al. | 34/600 |
| 6,026,592 | A | | 2/2000 | Herr | 34/446 |
| 6,351,894 | B1 | | 3/2002 | Lund et al. | 34/106 |
| 6,385,862 | B1 | * | 5/2002 | Vande Haar | 34/441 |

FOREIGN PATENT DOCUMENTS

EP 446167 A * 9/1991 ..... G01N/27/22

* cited by examiner

*Primary Examiner*—Charles H. Nolan, Jr.
(74) *Attorney, Agent, or Firm*—John F. Colligan; Robert O. Rice; Stephen Krefman

(57) ABSTRACT

A condition sensor for a fabric treating apparatus, such as a clothes dryer. A condition sensor is connected to a base wherein the condition sensor is operative to sense a condition such as moisture content for a multi-layered load placed within the dryer. The condition sensor comprises at least one support connected to the base wherein the at least one support has at least one extension attached thereto. A pair of capacitance sensors are attached to the at least one extension with the pair of capacitance sensors being arranged to build up charge through the condition sensor based on the moisture of the load content positioned in the dryer. A circuit is arranged to receive, read and generate signals in response to the charge of the capacitance sensors.

43 Claims, 5 Drawing Sheets

CONDITION SENSOR FOR A DRYER

BACKGROUND OF THE INVENTION

This invention relates to sensing a condition for a laundry apparatus, and is particularly concerned with methods and apparatus for sensing the moisture content of a multi-layered load within a dryer and controlling the operation of the dryer as a function thereof.

Resistance sensing of moisture in the surface of fabrics, typically clothing fabrics, is widely used and well known in clothes dryers. As moisture transfers from the inner section of single thickness fabric items to the outer surface, the moisture is removed from the surface by air and heat mechanisms. As soon as the surface is sufficiently dry, the resistance of the outer surface, as measured by a resistance sensor, changes in an amount sufficient to indicate dryness.

A problem occurs with resistance sensing, though, when the article has a greater thickness, such as a velour blanket, a comforter or a shoe. A problem also occurs when the article is made up of various different materials since the resistive sensing approach may sense the outer surface of one type of material as being dry. The inner portion of the item, such as a shoe innersole, however, could still be damp just below the dry surface due to the various layers of materials. Accordingly, moisture might remain in the article since it cannot migrate to the surface as readily as moisture can be removed from the top surface, resulting in damp clothing or over-drying of the article to insure dryness.

Shoes, in particular, defy effective resistive moisture sensing. Many shoes, especially athletic shoes, have an insole insert which consists of a fabric covering positioned on a molded foam rubber insole pad. This pad may possess such other features as an instep support. Beneath the insole insert is found an insole board, which is usually a fibrous pad, approximately 1.5–2.0 mm thick. The insole board typically covers small depressions in the molded outsole and generally provides uniform support to the insole insert. The insole board also absorbs moisture and tends to retain it rather well in known dryers presently used. Accordingly, because of the multi-layered construction of the foam rubber insole pad, when submitted to the typical drying process, the insert's top cloth surface can be detected as dry. The sub-surface foam rubber pad and insole, however, can still be wet.

Thus, prior to wearing shoes which have been wet, the user typically allows the shoes to dry, either by air drying or using a known dryer system. Air drying, however, requires a lot of time, while known dryer moisture detection systems indicate that the insert's cloth surface can be dry while the sub-surface foam rubber pad and the insole board can still be wet.

A need therefore exists for measuring the moisture content of a multi-layered load such as shoe interiors. The solution, however, must be capable of detecting moisture in material below the outer surface of the load. The solution must also operate the drying operation based on the moisture content. Further, the solution must be capable of detecting sub-surface moisture when the surface is dry. Further, a need exists for an efficient process to prevent overdrying of the load. The solution, however, must be capable of drying such a load to a wearable dry condition, but not to over dry, which could cause component material such as leather to lose natural oils leading to cracking. A need further exists for an efficient process of measuring the moisture by sensing the moisture content inside shoes such as below the soles. The solution, however, must efficiently support the shoes in the dryer.

Dryers currently available often apply resistance sensing. U.S. Pat. No. 4,422,247 uses two sensor strips, which when bridged by wet clothing, serve as a resistance (impedance) to discharge a charged capacitance. Since wet clothing has a lower resistance than dryer clothing, wet clothing will discharge the capacitance more quickly. By measuring the voltage of the capacitance at a predetermined time after contacting the clothing, the dryer then correlates wetness with remaining capacitance voltage via a basic R-C circuit, which in turn prevents a timer from advancing toward the off position. This system, though, does not solve the current need since it is not effective in sensing moisture just below the surface of multi-layered fabrics such as shoe interiors because the surface resistance of the cloth increases exponentially as dryness is reached. Accordingly, lower resistance just below the surface may exist, especially in bulky clothing or shoe soles, where a foam rubber material may exist just below the fabric liner of the sole.

Another typical known device comprises a drying rack working in conjunction with the resistance sensing strips. This drying rack is supported within the dryer but remains stationary, rather than rotating with the drum of the dryer. Therefore, items placed upon the rack are subjected to the heat of the dryer, but arc not tumbled with the rotating drum. The physical configuration of the sensors does not allow detecting of shoe interior surfaces and the sensing system works best with surface drying. Accordingly, the dryer cannot effectively sense the interior moisture content of the shoes.

Another prior art dryer rack comprises sensors connected to the rack wherein the shoes are placed on top of the rack. This drying rack, however, does not solve the current need since the sensors incorporate the resistance sensing previously mentioned. Further, this type of drying rack does not solve the current need since the sensors are not placed inside the shoes to measure the moisture within multiple layers.

U.S. Pat. No. 5,903,222 discloses an additional prior art moisture detector. This invention teaches a device for detecting wetness in diapers using a capacitance sensor. In this invention, the sensors are completely enclosed within a housing which is attached to the external surface of the diaper. Since the sensors must face the rear of the housing, the sensors do not contact the diapers. This device, however, does not solve the current need since the device does not contact the articles. Accordingly, the device would not effectively sense the moisture of multi-layered materials having diverse compositions for each layer.

SUMMARY OF THE INVENTION

The present invention provides for a condition sensor for a laundry apparatus, in particular, a condition sensor that measures the moisture content in a multi-layered load.

To that end, the invention provides a device and method that efficiently and economically determines the moisture content of items, such as shoes, and signals operating controls to the dryer based on the moisture content.

Described in the accompanying drawings and following text is a condition sensor that measures the moisture content of the multi-layered load based on measuring the permittivity of the load, rather than a resistance of the surface of the load. This configuration leads to improved drying of multi-layered loads. Thus, the present invention disclosed herein provides a condition sensor which overcomes many of the inadequacies of dryers known in the art.

In an embodiment, the present invention provides a condition sensor device for a dryer. The housing of the dryer encloses a drum wherein an air moving device, which is operated by a dryer control, directs a stream of air through the drum. A capacitance sensor located within the drum measures the permittivity of a non-tumbling load positioned within the drum. The capacitance sensor then communicates with the dryer control to control the operation of the air moving device based on the measured permittivity of the load.

In an embodiment, the present invention provides a device for a dryer comprising a base and a condition sensor connected to the base wherein the condition sensor is operative to sense a condition of the load positioned within the dryer. The condition sensor comprises at least one support connected to the base wherein the at least one support has at least one extension attached thereto.

A pair of capacitance sensors are attached to the at least one extension with the pair of capacitance sensors being arranged to build up charge through the condition sensor, charge level dependent on the moisture content of the load positioned in the dryer. The invention also provides a circuit arranged to receive, read and generate signals in response to the charge of the capacitance sensors.

In an embodiment, the present invention provides a condition sensing device for sensing the moisture content of a load placed in a dryer wherein a base is removably connected to the dryer.

In this embodiment, a condition sensor is connected to the base. The condition sensor which senses the moisture content of the load while the load is being dried by the dryer comprises a pair of supports positioned on the base wherein a pair of capacitance sensors are attached to each support to contact the load.

Further, the pairs of capacitance sensors are arranged to build up charge based on the permittivity of the load and a circuit is arranged to receive, read and generate signals in response to the charge of the capacitance sensors.

In an embodiment, the permittivity of the load is a function of the moisture content of the load. Additionally, the charge of the pair of capacitance sensors varies in relation to the permittivity.

In an embodiment, the present invention provides a fabric drying apparatus which senses the moisture content of a non-tumbling load placed in the treatment zone during the drying operation and adjusts the drying operation based on the moisture content. This embodiment comprises a dryer and a base connected to the dryer wherein the base is positioned to extend into the treatment zone of the dryer when the door is in a closed position.

Further, a condition sensor is connected to the base with the condition sensor being operative to sense the moisture content of the load while the load is being processed by the dryer. The condition sensor comprises a pair of supports positioned on the base with each support having a pair of extensions attached to support the load. Additionally, a pair of capacitance sensors are attached to each pair of the extensions wherein each pair of capacitance sensors are positioned to contact the load and are arranged to build up charge based on the permittivity of the load.

The present invention further provides method of sensing the moisture content of the multi-layered load in a dryer. The method provides positioning the multi-layered load on a condition sensor and initiating a drying operation. Next, the method provides sensing the moisture content of the multi-layered load by measuring the permittivity of the multi-layered load during the drying operation.

The method further provides increasing the charge of the condition sensor in relation to the permittivity of the multi-layered load and communicating the charge of the condition sensor to a circuit. Based on the charge, operating signals are then sent to the dryer.

An advantage of the present invention is to sense the moisture content of multi-layered loads in the dryer.

Another advantage of the present invention is to sense the moisture content of multi-layered loads having different material compositions.

Another advantage of the present invention is sense the moisture content of a layer below a dry surface layer.

Another advantage of the present invention is to use capacitance sensing to sense the moisture content of multi-layered loads.

DESCRIPTION OF THE PREFERRED EMBODIMENTS

As discussed above, the present invention provides structures and other accommodations to sense the moisture content of a multi-layered load, as a shoe inner sole. The present invention efficiently and conveniently senses the moisture content and controls the drying operation as a function of the moisture content.

Figure 1:
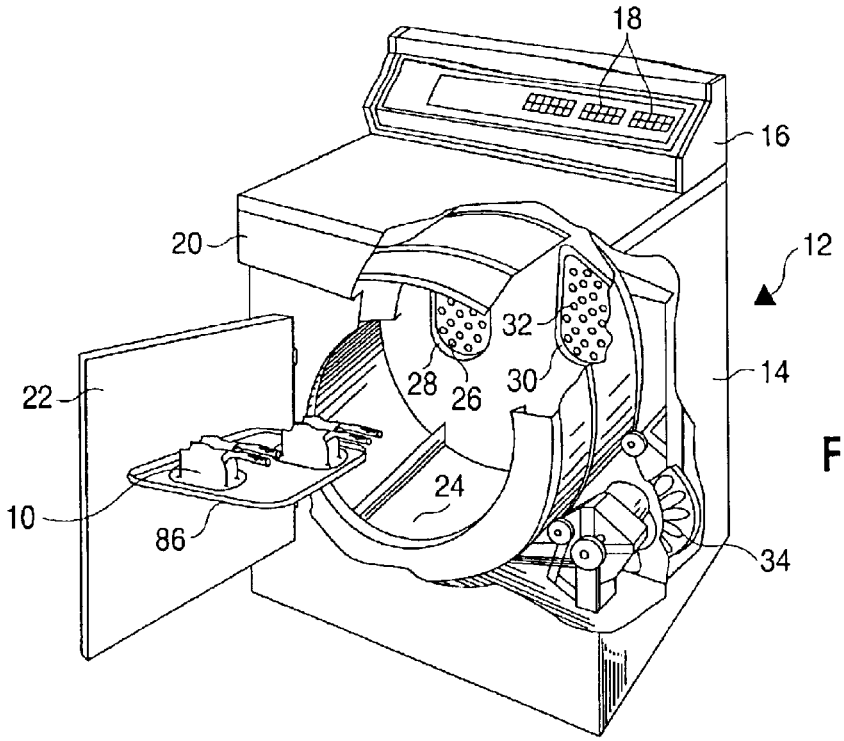
FIG. 1 is a perspective view of an automatic dryer embodying the principles of the present invention.

FIG. 1 illustrates a perspective view of an exemplary condition sensor 10 to measure the moisture content. In FIG. 1 there is generally shown an automatic dryer 12 having a housing 14 and a control console 16 with a plurality of controls 18 thereon. Each of the controls 18 may take the form of touch control switches. However, the controls 18 may be of any number of types commonly known in the art without departing from the spirit of the invention. The controls 18 provide the operator with the opportunity of preselecting a special custom mode of operation such as fabric selection, automatic dry, timed dry, air and touch-up drying cycles. A range of selections are available in each of the automatic and timed dry cycles.

A front 20 of the cabinet 14 has a door 22 which provides access to a treatment zone in the interior of the dryer 12 including a rotatable drum 24. Provided in a stationary bulkhead at the rear of the drum 24 there is an inlet aperture 26 with a screen or perforate cover plate 28 across the inlet aperture 26. Additionally, an outlet aperture 30, formed by perforations 32, is positioned in the drum rear through which a supply of temperature conditioned air is circulated by an air moving device 34 such as a blower or fan during the drying process.

Figure 2:
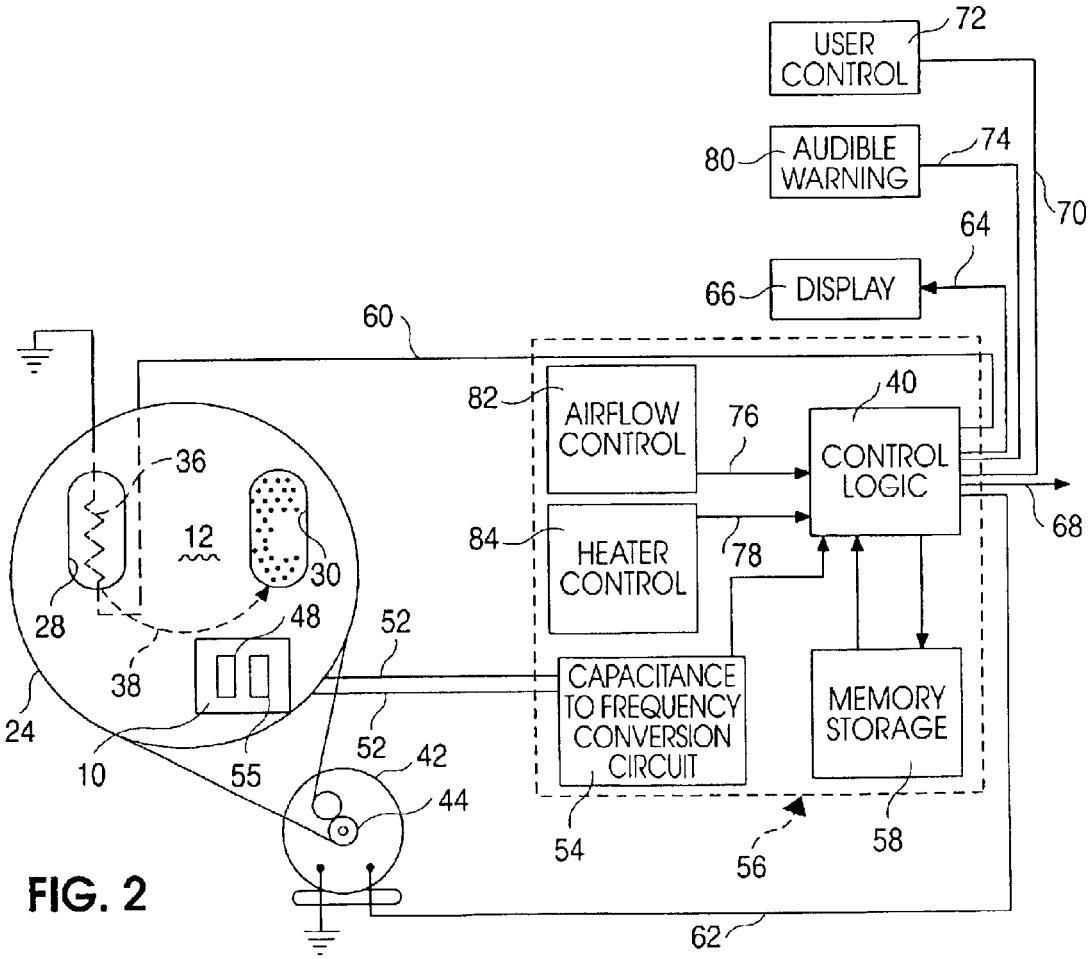
FIG. 2 is a schematic diagram of a dryer including a dryer control circuit according to the present invention.

Turning to FIG. 2, a heating element 36 is provided in the air flow path designated by broken arrow 38 which is selectively energized by a control logic circuit 40 to selectively temperature condition the air to the interior of the dryer 12 as required, thereby conditioning the air to take on increased moisture. The air moving device 34 is connected in an air flow relationship with the inlet aperture 26 and outlet aperture 30 so that air is drawn into the drum 24 by way of inlet aperture 26 after first passing the heating element 36 and is withdrawn from the drum 24 through the outlet aperture 30. An electric motor 42 drives the air moving device 34 and is also provided to rotate the drum 24 by means of a drive mechanism 44.

At least one condition sensor 10 is provided which can be in contact with a non-tumbling load 46 (shown in FIG. 3) during the drying operation while the drum 24 is rotating. The load 46 may comprise a single layer of fabric or multi-layers of fabric with different material compositions. The condition sensor 10 is comprised of two capacitance sensor plates 48 and 50 which are connected by leads 52 to a capacitance to frequency conversion circuit 54 as shown in FIG. 2.

A digital control circuit is generally shown at 56 and includes the capacitance to frequency conversion circuit 54 which is connected to capacitance sensors 48 and 50. The digital control circuit 56 also includes a memory storage 58 and the control logic circuit 40 for reading stored values in the memory storage 58.

The control logic circuit 40 includes a plurality of outputs for controlling various machine functions and, accordingly, for controlling the program of the dryer 12. A first output is indicated by the electrical connection line 60 which extends from the control logic circuit 40 to the heating element 36 for controlling the application of heat to the interior of the drum 24. A second output is indicated by means of an electrical connection line 62 which extends from the control logic circuit 40 to the electrical motor 42 for controlling rotation of the drum 24 and the blower 34.

A third output is indicated by an electrical connection line 64 which extends from the control logic circuit 40 to a display circuit 66 which controls a number of indicator lamps behind the panel on the control console 16 (shown in FIG. 1) of the dryer 12 to indicate to the operator which drying functions have been selected and in which portion of the drying cycle the dryer 12 is currently operating. Another output is evidenced by the electrical connection line 68 which may be employed, for example, as a master power control lead for disconnecting the circuits from the electrical supply at the termination of the drying program.

An additional output is indicated by electrical connection line 70 which extends from the control logic circuit 40 to a user control circuit 72 which allows the operator to input different drying controls. Additional outputs are indicated by electrical connection lines 74, 76 and 78 which extend from the control logic circuit to an audible warning 80, an airflow control 82 and heater control 84 as known in the art.

As will be appreciated by those skilled in the art, the electrical connections 60, 62, 64, 66, 70, 74, 76 and 78 are in schematic form only, and in practice appropriate interface circuitry such as is well known in the art would be necessary to enable the relatively low level signals developed by the logic circuitry to be used to control the power supply to the machine components.

Figure 3:
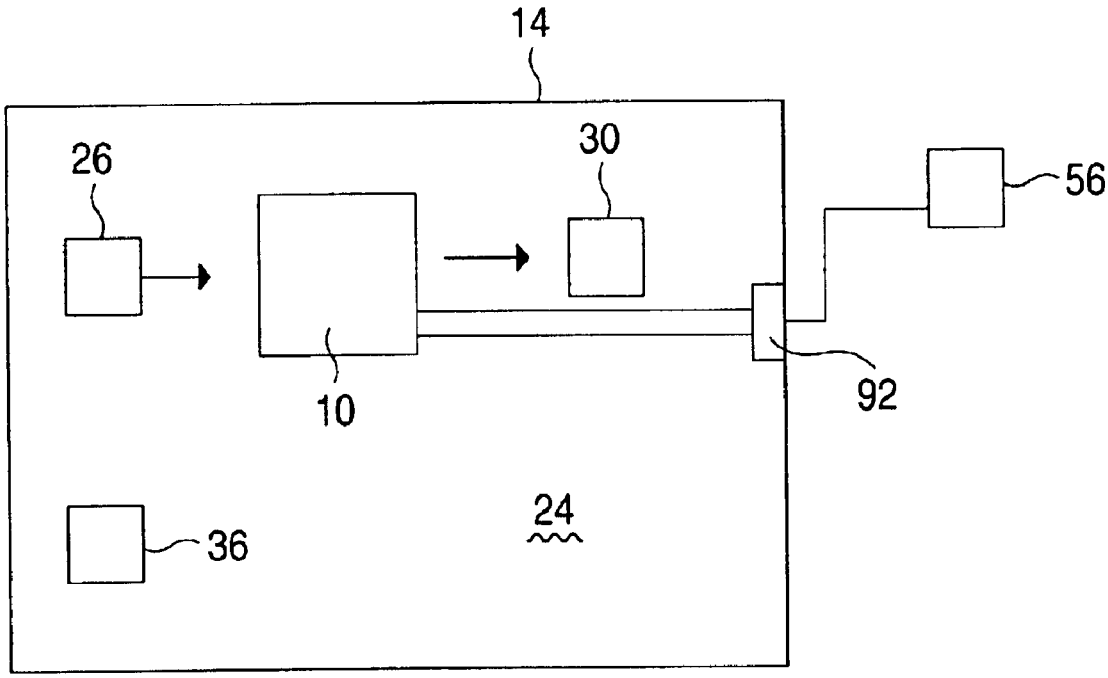
FIG. 3 is a schematic diagram embodying principles of the present invention.

Turning to FIG. 3, a functional schematic of the present invention is shown. The housing 14 encloses the drum 24 wherein the air moving device 36 directs a stream of air through the drum 24. The housing 14 further encloses the capacitance sensor 10 within the drum 24. The capacitance sensor 10, in turn, communicates the permittivity of the load 46 (shown in FIG. 4) to the digital control circuit 56 via the plug 92. Air, represented by the arrows, transfers from the air inlet aperture 26 to the air outlet aperture 30 by the air moving device 36 around the capacitance sensor 10 to dry the load 46.

Figure 4:
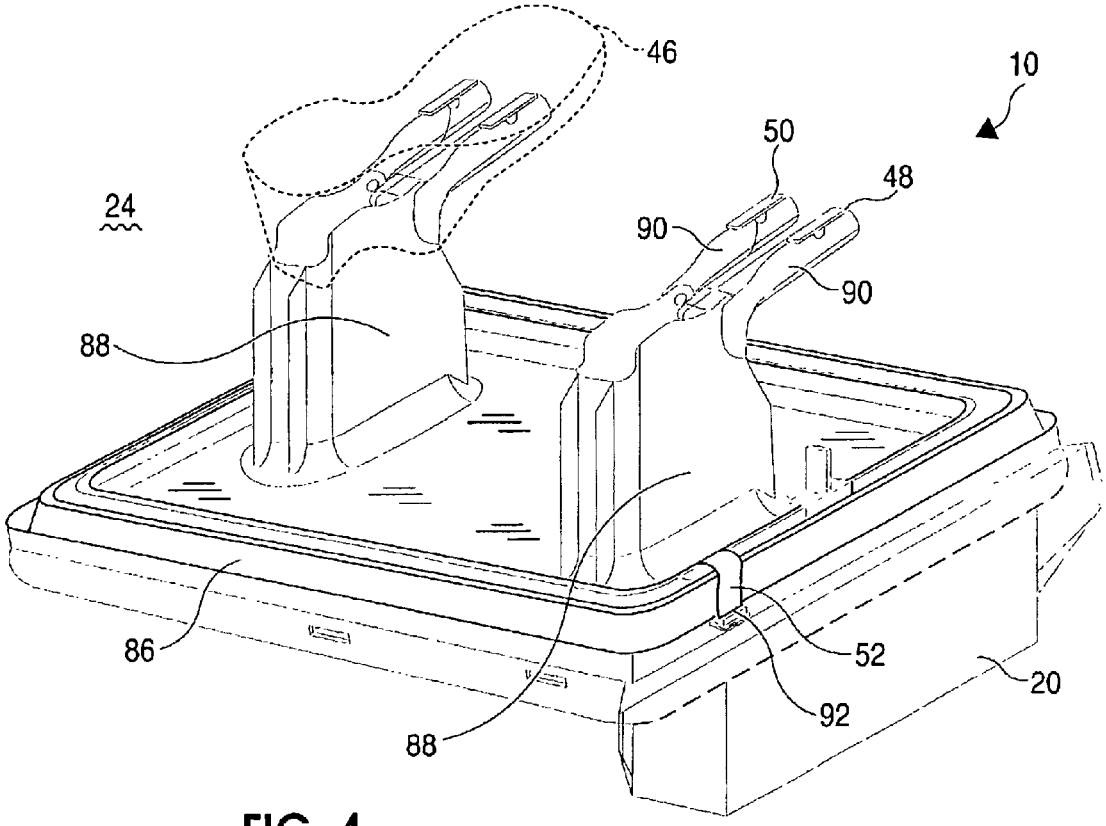
FIG. 4 is a perspective view of an assembly containing a condition sensor for shoes.

Turning to FIG. 4, the present invention comprises a base 86 wherein the condition sensor 10 connects to the base 86. The condition sensor 10, in turn, comprises at least one support 88 connected to the base 86. In the illustrated embodiment, two supports 88 are shown. Additionally, each support 88 has at least one extension 90 attached to each support 88. The extensions 90 support the load 46, shown in FIG. 4, as a shoe in dotted lines, to be dried.

As shown in FIG. 4, a pair of capacitance sensor plates 48, 50 are attached to an end of each extension 90. The capacitance sensor plates 48, 50 are arranged to build up charge based on a condition, such as moisture content, of the load 46 during the dry cycle.

The capacitance charge produced by the capacitance sensor plates 48, 50 is received and read by the capacitance to frequency conversion circuit 54 (shown schematically in FIG. 2). Accordingly, leads 52 may connect the capacitance sensor plates 48, 50 to the capacitance to frequency conversion circuit 54 via a plug 92 as shown in FIG. 4.

In the present invention, the pair of capacitance sensor plates 48, 50 can pivot vertically about the extension 90. Because the pair of capacitance sensor plates 48, 50 may pivot, the sensor plates 48, 50 can obtain maximum contact surface with the load 46 when the load 46 is placed on the capacitance sensor plates 48, 50. Accordingly, for shoes, the capacitance sensor plates 48, 50 may pivot to contact the curved portions of the sole of the shoes. For a load such as a comforter, the supports 88 are shorter to provide greater fabric volume without interference from the rotating drum or baffles.

Alternatively, the supports 88 may be adjustable to provide different heights. Thus, for non-uniform loads such as a bundled comforter, the capacitance sensor plates 48, 50 may pivot to achieve maximum contact with the load 46.

The extensions 90 may also pivot about the support 88. Accordingly, the extensions 90 may be adjusted in length to accommodate different types and sizes of shoes such as sandals or boots.

In the illustrated embodiment of FIG. 4, the capacitance sensor plates 48, 50 communicate to the capacitance to frequency conversion circuit 54 via the leads 52. In another embodiment, the capacitance sensor plates 48, 50 can communicate via a wireless link as known in the art to eliminate the leads 52.

Further, in the illustrated embodiment of FIG. 1, the supports 88 are shown extending away from the door 22. In another embodiment, the supports 88 may be rotated to present the extensions 90 facing the user as the user opens the door 22.

Figure 5:
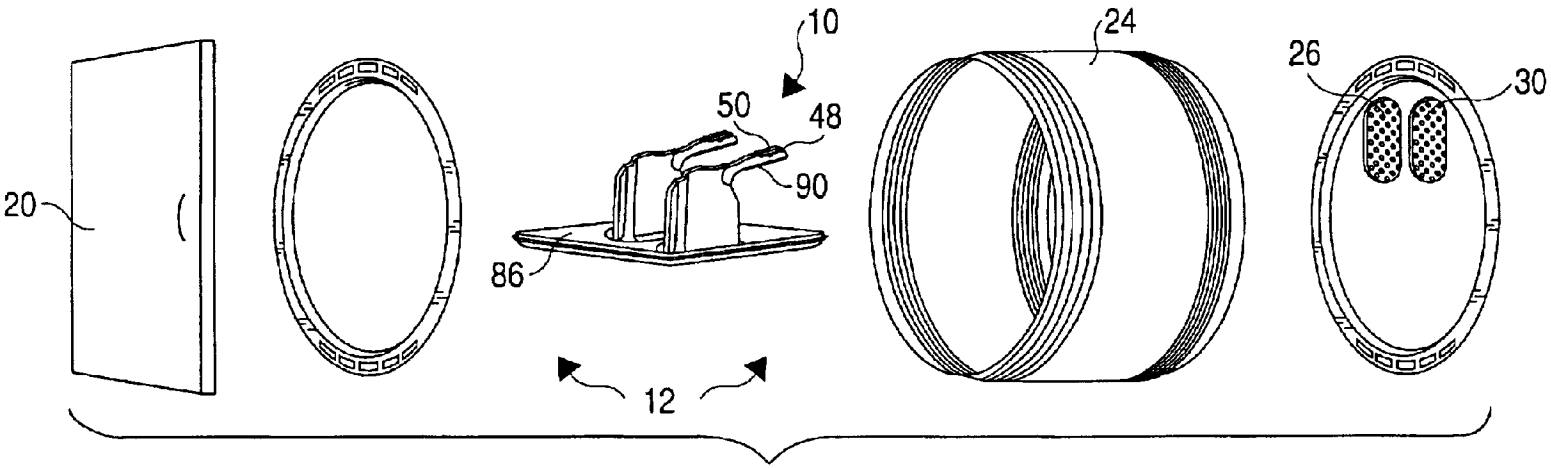
FIG. 5 is a breakaway view of the assembly containing the condition sensor and the components comprising the dryer drum area and the treatment zone.

Turning to FIG. 5, an exploded view of the drum 24 and door 22 is shown with the condition sensor 10. The drum 24 is cylindrically shaped and includes a front and a back. When the dryer 12 is operating, the drum 24 rotates in order to tumble the clothes within the dryer 12 wherein the front and back of the drum 24 in this embodiment remain stationary while the drum 24 rotates. When the base 86 is installed as described, and the drum 24 rotates, preferably the base 86 (mounted to the stationary drum front/rear) remains stationary in the manner described below. Therefore, the load 46 placed on the extensions 90 will not tumble within the dryer 12 but will still be dried by the heated air within the dryer 12. As known in the art, components of the drum 24 may not be configured for disassembly but are shown in an exploded view for clarity.

Returning to the illustrated embodiment of FIG. 1, the base 86 is shown positioned within the drum 24 and removably connected to the front of the drum 24. In another embodiment, the base 86 may removably connect to the rear of the drum 24. Additionally, in another embodiment, the base 86 may be adapted to fit within the drum 24 and be supported at ends by rear of the drum 24 and the front of the drum 24 or the door 22 itself. In these configurations, the base 86 does not rotate with the drum 24. Regardless of the positioning of the base 86, the stationary load 46 directly contacts the capacitance sensor plates 48, 50. Thus, during the drying operation, the capacitance sensor plates 48, 50 measure the moisture content of the load 46 as will be discussed.

Figure 6:
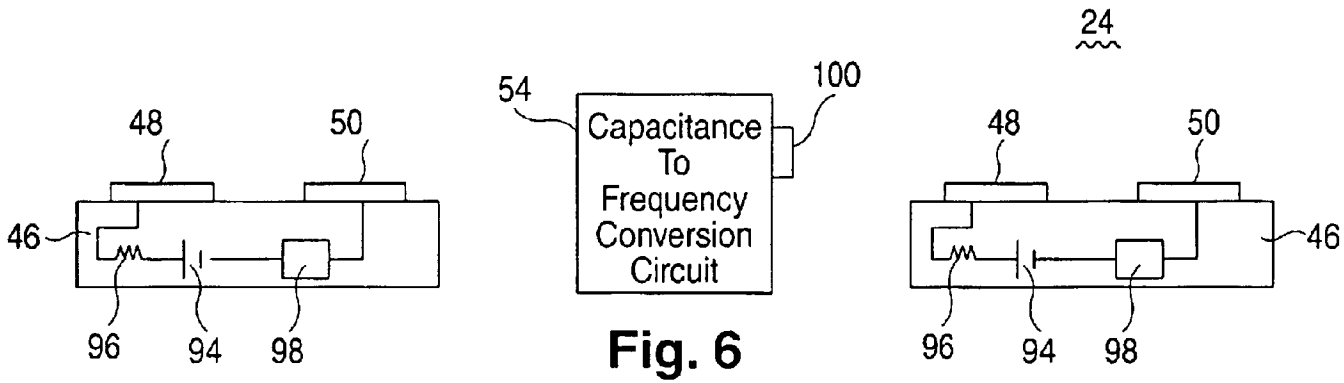
FIG. 6 is a schematic view of the condition sensor and the circuit utilized in an embodiment of the present invention.

Turning to FIG. 6, another embodiment of the present invention is shown. In this embodiment, the capacitance sensor plates 48, 50 are not hard wired with the capacitance to frequency conversion circuit 54. Additionally, the capacitance sensor plates 48, 50 are not supported by the base 86, supports 94, or extensions 90. Accordingly, the capacitance sensor plates 48, 50 are free to rotate with the load 46 within the tumbling drum 24. Thus, in this embodiment, the capacitance sensor plates 48, 50 are placed directly in the load 46, for example, inside the soles of the shoes. In this configuration, the capacitance sensor plates 48, 50 communicate with the capacitance to frequency conversion circuit 54 via a wireless link as the capacitance sensor plates 48, 50 tumble with the load 46. Thus, the capacitance sensor plates 48, 50 are powered by a circuit having a power source 94 and resistor 96 as known in the art. Accordingly, a transmitter 98 associated with the capacitance sensor plates 48, 50 would send the signal to a receiver 100 associated with the capacitance to frequency conversion circuit 54.

Figure 7:
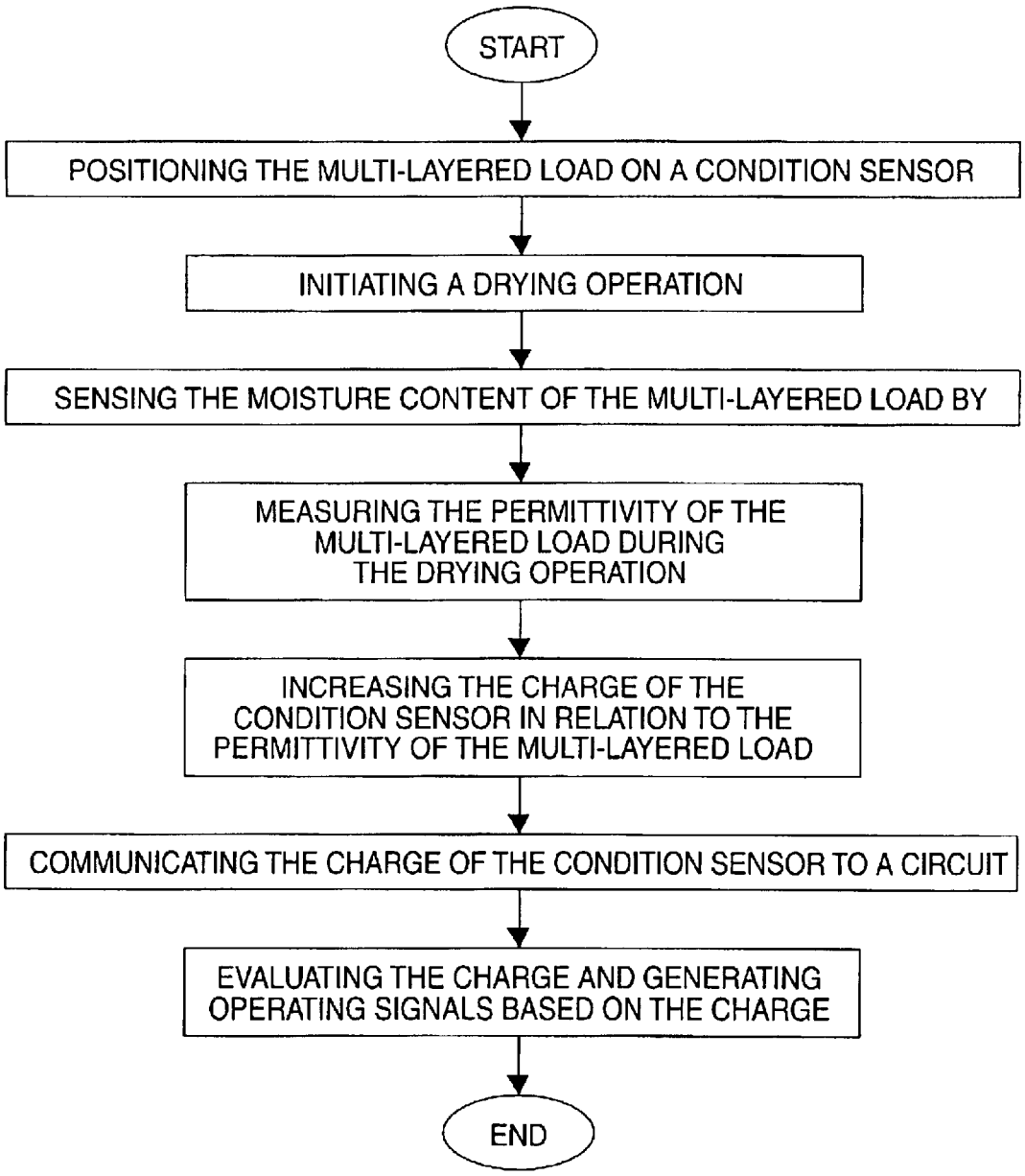
FIG. 7 is a flowchart of a method utilized in the present invention.

In use, the present invention provides a unique method of sensing and measuring a condition such as load moisture in the microcomputer controlled dryer 12 based on the level of moisture retention in the load 46. In particular, the present invention provides a unique method of sensing the moisture content of the multi-layered load 46. Accordingly, the present invention can detect moisture under a dry surface. Turning to FIGS. 4 and 7, an exemplary method of the present invention is shown. In use, the condition sensor 10 is positioned within the dryer 12 via the base 86. The user may connect the base 86 to the door 22 or to the front or rear of the drum 24 or both. In the illustrated embodiment of FIG. 4, the load 46 is placed on the components of the condition sensor 10.

As shown in FIG. 4, the load 46 may comprise a shoe which is placed inverted with the open end of the shoe positioned down onto the support 88. Thus, as shown, the extensions 90 support the load 46 in order for the capacitance sensor plates 48, 50 to achieve maximum contact area with the load 46. In another method, the user can put the load 46 such as a comforter on the extensions in order for the capacitance sensor plates 48, 50 to achieve maximum contact with the load 46. In this use, the shorter/adjustable supports 88 would be desirable.

Next, upon closing the door 22, the user initiates the drying operation. During the drying operation, the condition sensor 10 senses the moisture content of the load 46 as shown in FIG. 7 by measuring the permittivity of the load 46 to determine the moisture content.

The pivoting capacitance sensor plates 48, 50 form a capacitor where the capacitance is significantly lower when the contacted load 46 is damp than the value of capacitance when the load 46 is dry. Thus, the change of the condition sensor 10 increases in relation to the dielectric constant of the load 46. This charge increase occurs because the permittivity of the material, the load 46, between the capacitance sensor plates 48, 50 is a function of the moisture content of the load 46 and the moisture level of the load 46 itself. Since the capacitance sensor plates 48, 50 have a constant area and the spacing between the capacitance sensor plates 48, 50 remains constant during the drying operation, the capacitance varies as the permittivity of the load 46 varies. Accordingly, the capacitance varies as the load 46 dries.

Referring to FIGS. 2, 4 and 7, the leads 52 communicate the charge from the capacitance sensor plates 48, 50 to the capacitance to frequency conversion circuit 54. The capacitance to frequency conversion circuit 54 in turn transmits the capacitor charge to the control logic 40 as shown in FIG. 2. Accordingly, the charge is processed by the control logic 40 to determine the drying operation. When the capacitance has reached a predetermined level, the control logic 40 terminates the drying operation.

Thus, capacitive sensing of moisture in loads 46 with multi-layers such as footwear uses the principle of a varying permittivity of the dielectric of the capacitance formed between the two capacitance sensor plates 48, 50. The change in permittivity is caused by the changes in the moisture content of the dielectric as the load 46 of bulky clothes or the footwear dries.

Since moisture affects the permittivity of the load 46 as measured by the capacitance sensor plates 48, 50, the resultant capacitance varies significantly from a damp material to a dry material. As the damp sub-surface dries, the capacitance increases in a smooth manner. When the capacitance of the capacitance sensor plates 48, 50 reaches a determined level, the dryer 12 can turn off, preventing an over-dry condition of the load 46. Thus, the present invention provides a unique apparatus and method to determine the moisture content under a dry surface and/or the moisture content of multiple layers in the load 46.

As utilized in the present invention, the control logic 40 first outputs a signal to read the charge of the capacitance sensor plates 48, 50. However, if there is wet load 46 in contact with the condition sensor 10, then current will not flow through the condition sensor 10 and the capacitance sensor plates 48, 50 will charge. Thus, if the capacitance sensor plates 48, 50 are connected across a voltage material such as the load 46, charge will build up between the capacitance sensor plates 48, 50.

This condition is monitored for a preselected length of time during which time the capacitance sensor plates 48, 50 can discharge the condition sensor 10. If wet clothes are in contact or come in contact with the condition sensor 10 during this period, the capacitance sensor plates 48, 50 will charge the condition sensor 10. If no clothes or dry clothes are in contact with the capacitance sensor plates 48, 50, then the condition sensor 10 will remain uncharged.

At the end of the preselected time, the condition of the control logic 40 is changed so that it reads the charge on the capacitance sensor plates 48, 50. If a low voltage or charge is read, this is interpreted as a wet signal which causes a counter to continue the drying operation. If a high voltage or charge is read by the control logic 40, this is interpreted as a dry signal which allows the drying operation to cease.

If the control logic 40 determines that the dryer 12 is in the sensing or timed portion of the drying operation, then the control logic 40 inspects the cycle selections to determine if the damp dry dryness level has been selected. If the control logic 40 determines that damp dry has not been selected, then the control logic 40 inspects the cycle selections to determine if the very dry level of dryness had been selected. It should be understood that any number of dryness levels may be utilized in the control logic 40 which would allow an operator to select from a range of dryness levels for the loads 46 being treated in the dryer 12.

If the control circuit 56 has passed through all of the various dryness level control units and determines that the very dry level has not been selected, then control circuit 56 inspects the cycle selectors to determine which timed dry period has been selected and can inspect the total run time to determine if the time period has completely elapsed. If the control circuit 40 determines that the dryness level has been obtained, the control circuit 40 may determine the cool down time. If the control circuit 56 determines that the time period has not completely elapsed, then the control circuit 56 determines the appropriate drying time based on the reading by the capacitance to frequency conversion circuit 54.

Thus, it is seen that there is provided an apparatus and method for the low charge condition sensor 10 for the dryer 12 which senses the moisture content in the load 46 and sends an appropriate signal to a microcomputer for use in timing and control functions. Thus, the capacitance sensing of the present invention can detect moisture under a dry surface and interact with the drying process based on the moisture content.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. A condition sensor for a dryer comprising:

a housing enclosing a drying space;

an air moving device operated by a dryer control for directing a stream of air through the space; and a capacitance sensor located in the space to measure a permittivity of a load, the capacitance sensor communicating with the dryer control to control operation of the air moving device based upon the measured permittivity.

2. A condition sensor according to claim 1, wherein the capacitance sensor is mounted on a base located within the drying space.

3. A condition sensor according to claim 1, wherein the capacitance sensor is mounted to remain in direct contact with the load during a drying operation.

4. A condition sensor according to claim. 1, wherein the capacitance sensor comprises a pair of spaced apart sensors connected via leads to the dryer control.

5. A condition sensing device for a dryer, comprising:

a base;

a condition sensor connected to the base, the condition sensor being operative to sense a condition within the dryer, the condition sensor comprising at least one support connected to the base, the at least one support having at least one extension attached thereto, a pair of capacitance sensor plates attached to the at least one extension, the pair of capacitance sensor plate arranged to build up charge through the condition sensor based on the condition; and a circuit arranged to receive, read and generate signals in response to the charge of the capacitance sensor plates.

6. The condition sensing device of claim 5, further comprising leads attached to the pair of capacitance sensor plates.

7. The condition sensing device of claim 6, further comprising a plug connectable to the leads to communicate the charge value from the pair of capacitance sensor plates to the circuit.

8. The condition sensing device of claim 5, wherein the condition sensor communicates with the circuit via a wireless link.

9. The condition sensing device of claim 5, wherein the base connects to the dryer.

10. The condition sensing device of claim 5, wherein the pair of capacitance sensor plates are pivotable about the at least one extension.

11. The condition sensing device of claim 5, wherein the at least one extension is pivotable about the at least one support.

12. The condition sensing device of claim 5, wherein the condition sensor senses the condition of a load.

13. The condition sensing device of claim 12, wherein the condition is the interior moisture content of the load.

14. The condition sensing device of claim 12, wherein the at least one extension is configured to support the load.

15. The condition sensing device of claim 12, wherein the base is positioned within the load.

16. The condition sensing device of claim 12, wherein the load comprises shoes.

17. A condition sensing device for sensing the moisture content of a load placed in a dryer, comprising:

a base removably connected to the dryer;

a condition sensor connected to the base, the condition sensor being operative to sense the moisture content of the load while the load is being dried by the dryer, the condition sensor comprising a pair of supports positioned on the base, a pair of capacitance sensor plates attached to each support wherein each pair of capacitance sensor plates are positioned to contact the load, the pairs of capacitance sensor plates being arranged to build up charge based an the permittivity of the load; and a circuit arranged to receive, read and generate signals in response to the charge of the capacitance sensor plates.

18. The condition sensing device according to claim 17, wherein the pairs of capacitance sensor plates are arranged to charge through the condition sensor for a pre-selected period of time.

19. The condition sensing device according to claim 17, wherein the condition sensor operates at low capacitance levels.

20. The condition sensing device according to claim 17, wherein the permittivity of the load is a function of the moisture content of the load.

21. The condition sensing device according to claim 17, wherein the charge of the pairs of capacitance sensor plates varies in relation to the permittivity.

22. The condition sensing device according to claim 17, wherein the load is a multi-layered fabric article.

23. The condition sensing device according to claim 17, wherein the load is a pair of shoes where each pair of capacitance sensor plates contacts an individual shoe.

24. The condition sensing device according to claim 17, wherein the pairs of capacitance sensor plates are pivotable when contacted by the load.

25. A method of sensing the moisture content of multi-layered load in a dryer, comprising:

positioning the multi-layered load on a condition sensor having a capacitance that varies with a permittivity of the multi-layered load, initiating a drying operation;

sensing the moisture content of the multi-layered load by measuring the permittivity of the multi-layered load during the drying operation, increasing the charge of the condition sensor in relation to the permittivity of the multi-layered load;

communicating the charge of the condition sensor to a circuit; and evaluating the charge and generating operating signals based on the charge.

26. The method of sensing the moisture content of claim 25, further comprising connecting the condition sensor to the dryer.

27. The method of sensing the moisture content of claim 25, further comprising signaling the drying operation to continue for a pre-selected time based on the operating signals.

28. The method of sensing the moisture content of claim 25, further comprising terminating the drying operation when the charge value reaches a pre-selected level.

29. The method of sensing the moisture content of claim 25, wherein a pair of capacitance sensor plates associated with the condition sensor contact the multi-layered loads.

30. A fabric drying apparatus which senses the moisture content of a load placed in the treatment zone during the drying operation and adjusts the drying operation based on the moisture content, comprising:

a dryer;

a base connected to the dryer, the base being positioned to extend into the treatment zone of the dryer when the door is in a closed position, a condition sensor connected to the base, the condition sensor being operative to sense the moisture content of the load while the load is being processed by the dryer, the condition sensor comprising a pair of supports positioned on the base, each support having a pair of extensions attached thereto, a pair of capacitance sensor plates attached to each pair of the extensions wherein each pair of capacitance sensor plates are positioned to contact the load, the pair of capacitance sensor plates being arranged to build up charge based on the permittivity of the load; and a circuit arranged to receive, read and generate signals in response to the charge of the capacitance sensor plates.

31. The fabric drying apparatus of claim 30, wherein the pairs of capacitance sensor plates are arranged to charge through the condition sensor for a pre-selected period of time.

32. The fabric drying apparatus of claim 30, wherein the load comprises a pair of shoes.

33. The fabric drying apparatus of claim 30, wherein each pair of capacitance sensor plates pivotably contact the load.

34. The fabric drying apparatus of claim 30, wherein the base connects to the dryer.

35. The fabric drying apparatus of claim 30, wherein the base connects to a rear of the treatment zone.

36. The fabric drying apparatus of claim 30, wherein the condition sensor communicates with the circuit via at least one lead.

37. The fabric drying apparatus of claim 30, wherein the condition sensor communicates with the circuit via a wireless link.

38. The fabric drying apparatus of claim 30, wherein the moisture content is the interior moisture content of the load.

39. A condition sensor for a dryer comprising:

a housing enclosing a drying space;

an air moving device operated by a dryer control for directing a scream of air through the space; and a capacitance sensor located in the space having a capacitance that varies with a permittivity of a load in the space, the capacitance sensor communicating with the dryer control to control operation of the air moving device based upon the measured permittivity.

40. A condition sensor according to claim 39, a capacitance to frequency converter arranged to receive a capacitance charge value from the capacitance sensor.

41. A condition sensor according to claim 39, wherein the capacitance sensor is mounted on a base located within the drying space.

42. A condition sensor according to claim 39, wherein the capacitance sensor is mounted to remain in direct contact with the load during a drying operation.

43. A condition sensor according to claim 39, wherein the capacitance sensor comprises a pair of spaced apart sensors connected via leads to the dryer control.

* * * * *